United States Patent [19]

Tamba et al.

[11] Patent Number: 4,766,983

[45] Date of Patent: Aug. 30, 1988

[54] MUFFLER FOR V-TYPE ENGINE

[75] Inventors: Shinichi Tamba, Kakogawa; Hitomi Miyake, Kobe; Noboru Fukui, Kakogawa, all of Japan

[73] Assignee: Kawasaki Jukogyo Kabushiki Kaisha, Japan

[21] Appl. No.: 88,462

[22] Filed: Aug. 19, 1987

Related U.S. Application Data

[63] Continuation of Ser. No. 898,379, Aug. 20, 1986, abandoned.

[30] Foreign Application Priority Data

Sep. 2, 1985 [JP] Japan ..... 60-193427

[51] Int. Cl.[4] ..... F01N 7/10

[52] U.S. Cl. ..... 181/240; 181/204; 181/262; 181/263

[58] Field of Search ..... 181/204, 240, 211, 212, 181/262, 263

[56] References Cited

U.S. PATENT DOCUMENTS

| | | | |
|---|---|---|---|
| 1,522,032 | 1/1925 | Scarff | 181/263 X |
| 2,489,585 | 11/1949 | Necchi | 181/262 |
| 3,952,823 | 4/1976 | Hinderks | 181/263 X |
| 4,142,606 | 3/1979 | Vanderzanden et al. | 181/262 X |
| 4,265,332 | 5/1981 | Presnall et al. | 181/211 |
| 4,487,285 | 12/1984 | Watanabe et al. | 181/240 X |

*Primary Examiner*—B. R. Fuller

*Attorney, Agent, or Firm*—Eric P. Schellin

[57] ABSTRACT

A muffler for work vehicle V-type internal combustion engines is disclosed, which is mounted in a horizontal sideway position, with its axis placed perpendicularly with the longitudinal vehicle axis, kept a proper distance from the chassis or vehicle body so that it is disposed in full exposure to the atmosphere for proper cooling. A pair of spaced inlet ports are provided in the muffler, at locations adjacent to opposite ends thereof for receiving the exhaust gases from the engine through a pair of parallely extending, parallel exhaust pipes directly interconnected between the combustion chambers of the two cylinders and the muffler inlet ports, without using the conventional intermediate flexible corrugated connectors.

2 Claims, 4 Drawing Sheets

MUFFLER FOR V-TYPE ENGINE

This application is a continuation of application Ser. No. 898,379 filed Aug. 20, 1986 now abandoned.

BACKGROUND OF THE INVENTION (1) Field of the Invention

This invention relates to a muffler for work vehicle V-type engines.

(2) Description of the Prior Art

To reduce the noisy sound of the exhaust gases as they escape at high speed the exhaust pipes of V-type engines in work vehicles such as a tractor, power lawn mower, riding-type sprinkler and combine, various types of mufflers have so far been proposed in the prior art. Referring to FIG. 3, a typical conventional muffler 3, which is represented by laid-open Japanese utility model application No. 53-50317, is supported in a lengthwise position in the bottom of the chassis 1 of the vehicle, with its axis laid parallel with the centerline of the vehicle.

The exhaust pipe consists of an L-shaped inlet pipe 5 and an exhaust manifold 4. The inlet pipe 5 has its lower end connected to the inlet port of the muffler 3 and extends upward through the chassis 1 to put its upper end 5*a* for connection to the lower end 4*a* of the exhaust manifold 4. The inlet pipe 5 is connected to the exhaust manifold 4, not directly, but through a flexible corrugated connector 6, which is intended to prevent direct propagation of the vibrations from the muffler 3 to the engine while the vehicle is running on the road, since the muffler 3, mounted on the chassis 1, is subject to the vibrations owing to the conditions of the road surface. The exhaust pipe 4 consists of branched end portions 9 and 10 for connection to the separate combustion chambers of the two cylinders in work vehicle V-type engines.

However, those prior art mufflers have been found to have various difficulties. For example, in those work vehicles in which their V-type engine is mounted in a sidewise position, with the axis of the crankshaft laid perpendicularly with the longitudinal axis of the chassis, the arrangement is sometimes such that the one end portion 9 diverges from the extreme end of the exhaust pipe 4 while the other portion 10 branches off from it at a point some distance down from the junction where the portion 9 is joined to the exhaust pipe 4. This configurational asymmetry of the end portions 9 and 10 with respect to the exhaust pipe 4 has been proved to constitute a cause of imbalance in the output and exhaust efficiency of the cylinders 7 and 8.

Furthermore, in applications where the muffler 3 is mounted in a lengthwise position, as in FIG. 3, the muffler 3 stands with its side of the smaller surface area oriented in the direction of movement of the vehicle, which means a rather reduced cooling effect in the flow of air generated by the moving vehicle. This is not advantageous, since cooling helps a muffler to reduce the exhaust noise.

In addition, the provision of the flexible corrugated connector 6 makes the entire exhaust pipe system undesirably great in size, and extend in the vicinity of the engine fuel system and air intake device, exposing them to a constant danger of heating by the higher surface temperature of the exhaust pipe system when exhaust gases are flowing therethrough.

The present invention has been proposed to eliminate the above problems.

SUMMARY OF THE INVENTION

It is therefore a primary object of the present invention to provide an improved muffler for work vehicle V-type engines which is mounted for increased cooling and hence reduced exhaust noise.

It is a further object of the present invention to provide such a muffler which permits the employment of cylinder-to-muffler exhaust pipes of equal length for increased cylinder performance and exhaust efficiency.

It is an additional object to provide such a muffler which permits the use of an exhaust system of small size and simple structure.

The above and other objects, features and advantages of the present invention will be more fully understood and appreciated from the following description of specific embodiments taken together with the accompanying drawings.

DETAILED DESCRIPTION OF PREFERRED EMBODIMENTS

Figure 1:
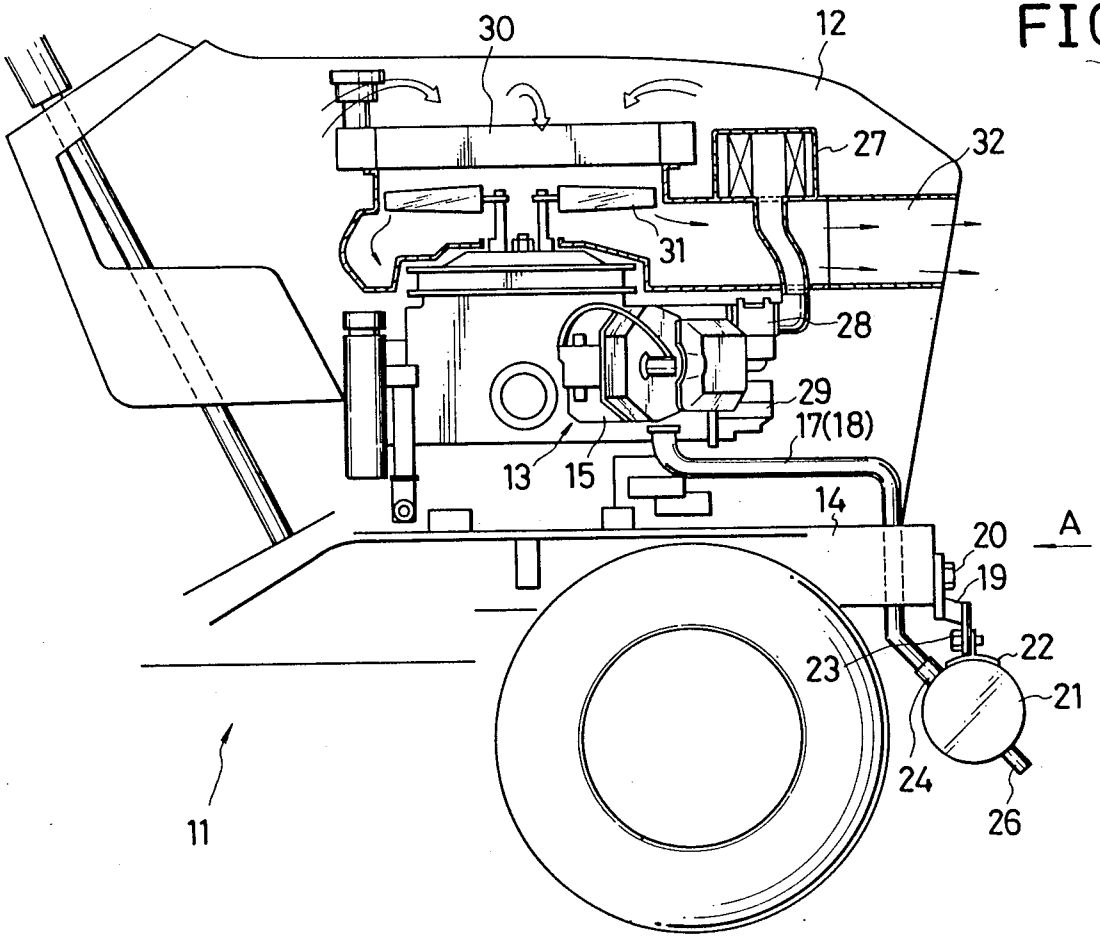
FIG. 1*a* is a side view of a first preferred embodiment of the muffler for work vehicle V-type engines according to, the present invention.
FIG. 1*b* is a top view of the embodiment depicted in FIG. 1*a;*
FIG. 1*c* is a rear view of the same embodiment, as seen in the direction of the arrow shown in FIG. 1*a;*
Figure 1:
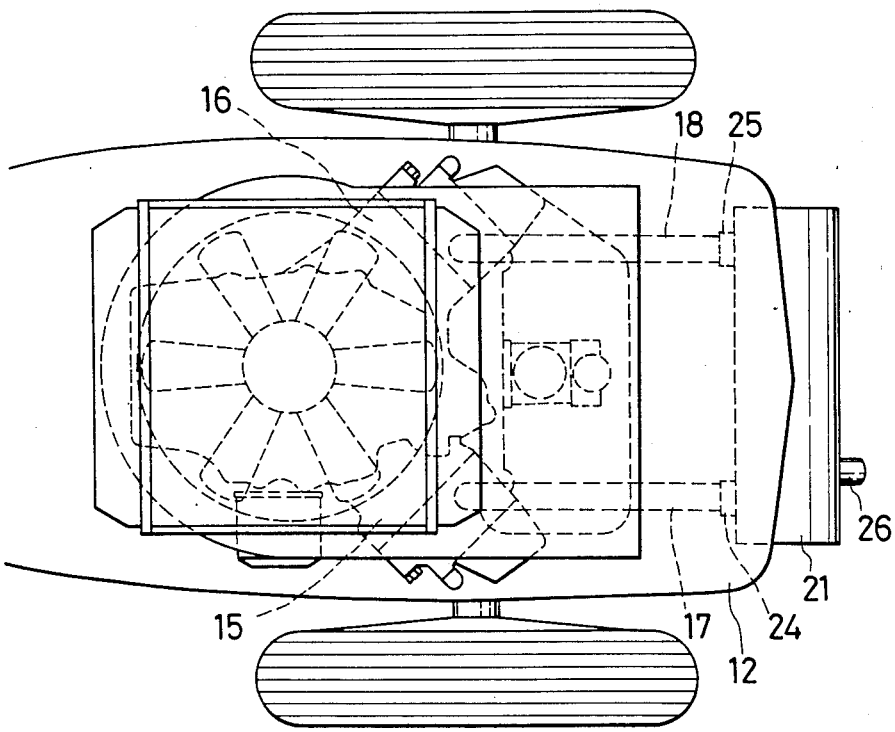
Figure 1:
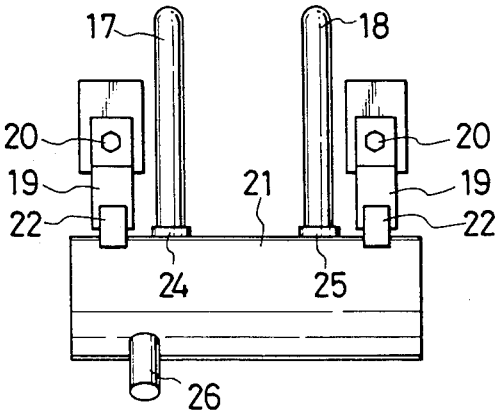
Figure 2:
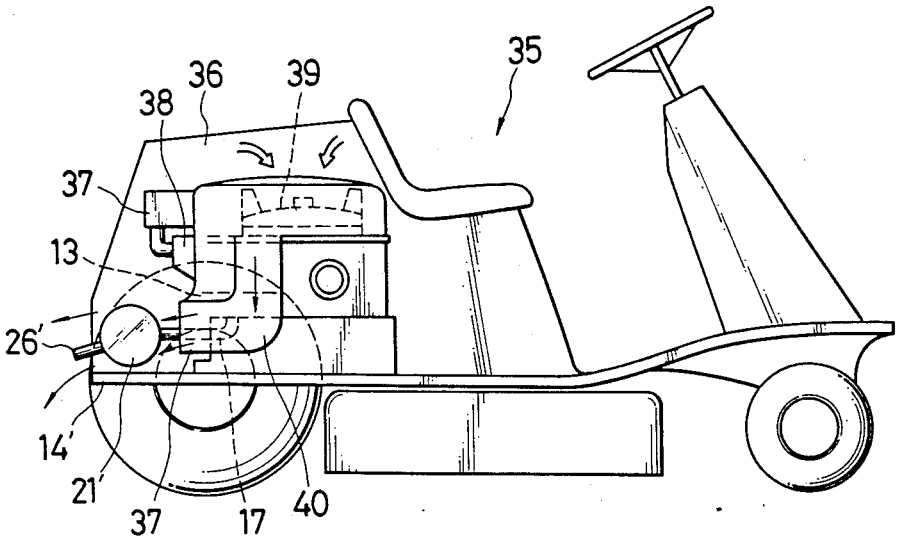
FIG. 2*a* is a side view of a second preferred embodiment of the present invention.
FIG. 2*b* is a top view of the embodiment depicted in FIG. 2*a*.
Figure 2:
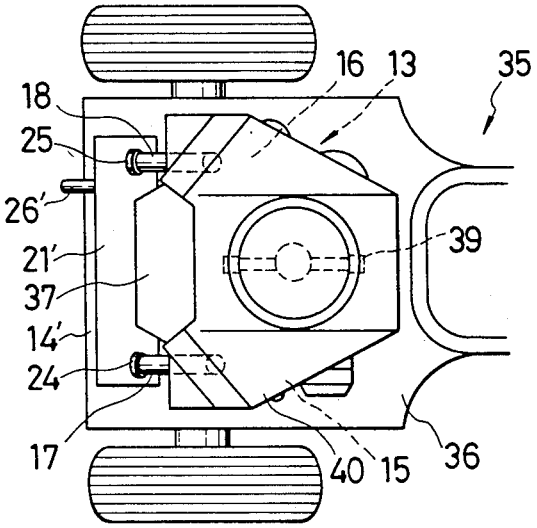
Figure 3:
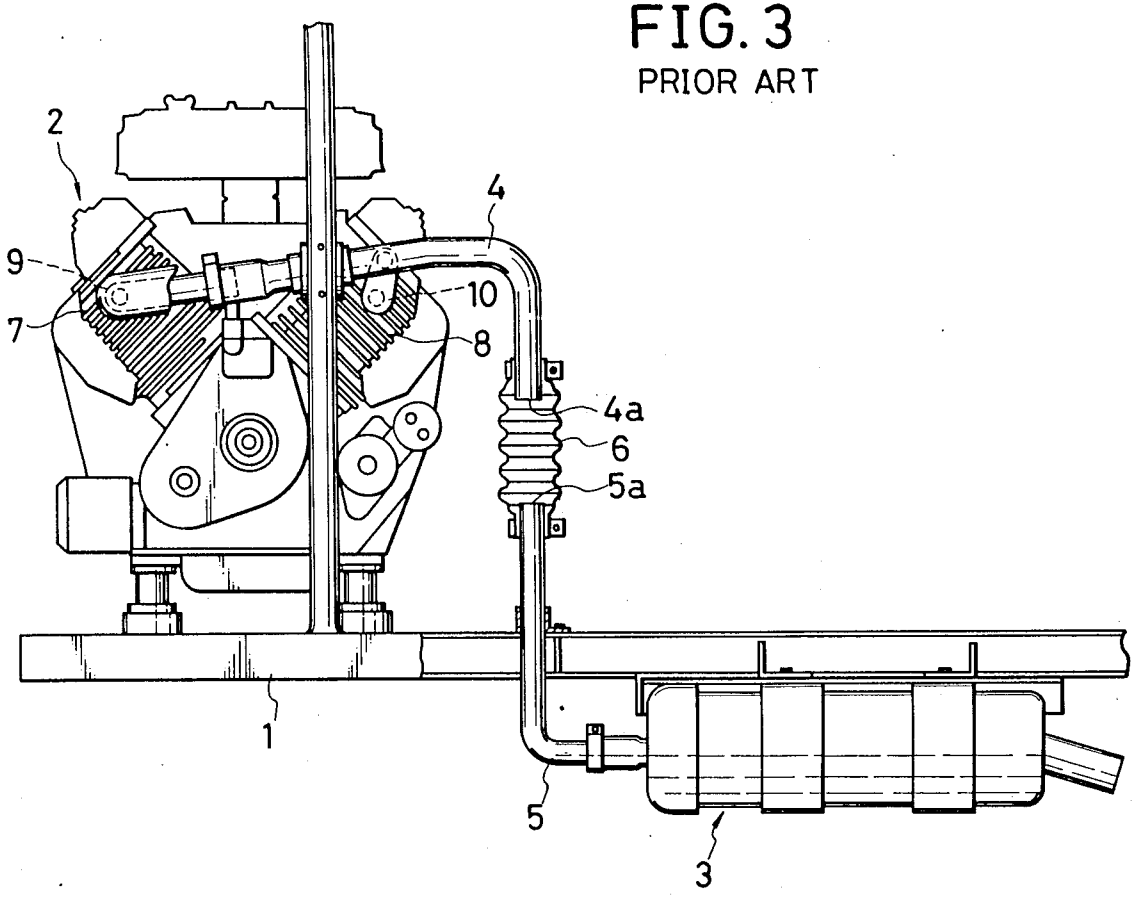
FIG. 3 PRIOR ART
FIG. 3 is a side view of a typical example of the conventional mufflers for work vehicle V-type engines.

Referring first to FIGS. 1*a* through 1*c*, features of the first preferred embodiment of the present invention will be described as it is mounted on a front engine tractor 11 having a chassis 14 and an engine compartment 12. A V-type horizontal engine 13 is installed on the chassis in the compartment 12, with its two cylinders 15 and 16 arranged symmetrically with respect to the center line of the chassis. Under the engine 13 are provided mounted a pair of parallel arranged, spaced exhaust pipes 17 and 18 which are in turn connected at a respective rear end thereof to the combustion chambers, not shown, of the cylinders 15 and 16 to receive exhaust gases therefrom.

A muffler 21 according to the present invention is mounted in front of the engine compartment 12 in a horizontal position, with its axis held perpendicularly with that of the engine crankshaft. The muffler 21 is held in place by a rigid muffler support 22 which is in turn secured fixedly to a lower end portion of a vibration proof rubber bracket 19 through a bolt 23. The bracket 19 is secured itself to a front part of the chassis 14 through a bolt 20.

Also, the muffler 21 has a pair of spaced inlet ports 24 and 25, located adjacent to opposite ends thereof, respectively, on the side facing the engine compartment. The exhaust pipes 17 and 18 extend forward and bend downward at a point adjacent to the front wall of the compartment 12 to brings their forward ends to connect to the ports 24 and 25, respectively.

With this arrangement, the exhaust gases generated in the cylinders 15 and 16 are conducted through the exhaust pipes 17 and 18 to the muffler 21 and discharged to the atmosphere, with proper noise reduction, through a tilted tail pipe 26 that is provided on the muffler on the opposite side to the ports 24 and 25.

In the drawings, the numeral 29 designates a fuel pump which supplies fuel to the engine 13 through the carburetor 28, which is also connected to the air cleaner 27 for air intake. The engine 13 is also provided with a radiator 30, a fan 31 and a hot air discharge duct 32 for engine cooling. Since the operation of the engine 13 and its cooling system are known to those versed with the art, no description will be given here.

Referring then to FIGS. *2a* and *2b*, a second preferred embodiment of the present invention will be described, as it is mounted on a riding type rear engine lawn mower, largely indicated at 35 in the drawing, having an engine compartment 36 and a chassis 14'.

A vertical shaft V-type engine 13 is mounted in the compartment 36, with its cylinders 15 and 16 disposed symmetrically with respect to the center line of the vehicle body. Under the engine 13 are provided mounted a pair of parallel arranged, spaced exhaust pipes 17 and 18 which are connected at a respective rear end to the combustion chambers of the cylinders 15 and 16 to receive exhaust gases therefrom when the engine is running.

A muffler 21' according to the second embodiment of this invention is mounted on the chassis 14' adjacent to the rear wall of the compartment 36, disposed in a horizontal position, with its axis extending perpendicularly with the longitudinal axis of the vehicle body.

Also, the muffler 21' has a pair of spaced inlet ports 24 and 25, located adjacent to opposite ends thereof. The exhaust pipes 17 and 18 extend rearwardly to bring their rear ends to connect to the ports 24 and 25, respectively.

With this arrangement, the exhaust gases generated by the cylinders in operation are conducted through the exhaust pipes 17 and 18 to the muffler 21' and discharged to the atmosphere through a downwardly tilted tail pipe 26' that are connected to the muffler 21' on the side opposite to the ports 24 and 25. The tail pipe 26' may preferably be opened to the atmosphere through an opening 37 bored in the lower rear wall of the comaprtment 36.

The engine 13 has a carburetor 38 and, during operation, is supplied with fuel from the fuel supply and air through an air cleaner 37. A fan 39 and a pair of cooling air ducts 40 are provided adjacent to the cylinders 15 and 16 to send cooling air through lower open ends of the ducts to cool the exhaust pipes 17 and 18 and the muffler 21'.

In either of the above embodiments, since the muffler 21, 21' is bodily disposed in parallel with the axis of the engine crankshaft, the exhaust pipes 17 and 18 interconnected between the combustion chambers of the cylinders 15 and 16 and muffler inlet ports 24 and 25 are made substantially equal in length, permitting the equally distributed flow of exhaust gases between the exhaust pipes 17 and 18 during the engine operation. Consequently, output and exhaust efficiency can also be equalized between the cylinders 15 and 16.

Furthermore, since the muffler 21 is mounted in a sidewise, with the side of the larger surface area oriented in the direction of movement of the vehicle, as may best be depicted in FIG. *1b*, it can be conveniently cooled by the flow of air as the vehicle is moving in operation. Furthermore, if the muffler body is held detached enough way from the chassis 14 to expose its external surface to the atmosphere, proper cooling of the muffler 21 can be achieved even when the vehicle is standing still.

As for the second embodiment in FIGS. *2a* and *2b*, in the back of the engine compartment 36, the muffler 21' is placed in full exposure to the streams of cooling air discharged from the outlet ports 37 of the cooling air ducts 40 so that the muffler is properly cooled during the operation.

Also, in either preferred embodiment, since the manner in which the muffler 21, 21' can be installed with practical efficiency and performance on its vehicle enables its mounting location to be fixed near the engine 13, the exhaust pipes 17 and 18 laid to interconnect the muffler inlet ports 24 and 25 and cylinder combustion chambers can be direct, without the intermediary of additional flexible corrugated connectors, and thus relatively short in length. In addition, this arrangement serves to have the exhaust pipes 17 and 18 supported at a proper distance away from the fuel and air intake systems so that the latter are less affected by the heat emitted from the surface of the exhaust pipes when the engine is running.

The muffler may be mounted directly on the engine shell in rigid integration, welded in fixed position at two points in the muffler body.

In construction, since the muffler according to the present invention can eliminates the additional intermediate flexible connector and exhaust pipe, conventional attaching operations can be saved. In addition, the exhaust pipes 17 and 18 may be formed from a one-piece pipe material, with simple pipe bending work.

Although the above preferred embodiments have been described in view of application for those V-type engines with the axis of their crankshaft placed perpendicular with the longitudinal axis of the vehicle, they can be employed for V-type engines with their crankshaft axis held parallely with the longitudinal vehicle axis as well. In this case, the muffler may be supported in an erect or tilted position.

What is claimed is:

1. A muffler for a V-type internal combustion engine employed in a work vehicle, said engine being of the type which includes a crankshaft, a pair of cylinders disposed symmetrically in a V-shape with respect to a horizontal plane defined perpendicularly with an axis of said crankshaft, and a pair of exhaust outlet ports provided at ends of said cylinders, comprising:

a pair of spaced inlet ports provided on opposite ends of said muffler and facing the engine compartment, for receiving exhaust gases from said exhaust ports;

a pair of exhaust pipes which extends forward and bend downward at a point adjacent to a front wall of said compartment and which is interconnected between said inlet ports and exhaust outlets, so that exhaust gases are directly discharged from the muffler to the atmosphere through a tailpipe having a substantially uniform cross-section throughout the entire length connected to the muffler; wherein the cylinder to muffler exhaust pipes are constructed into an equal length for increased cylinder performance and exhaust efficiency, and wherein said muffler is supported horizontally on a plane defined perpendicularly with the axis of said crankshaft at either a front or rear of the vehicle outside an engine compartment in which said engine is housed, at a location away from an external surface of the vehicle in order to expose the entire external surface of said muffler to the atmosphere for cooling, and mounted such as to have an axis thereof extending at right angles with a center line of the vehicle.

2. A muffler as set forth in claim 1, wherein said muffler includes a cooling system consisting of a cooling duct that is connected at one open end to a cooling fan, said cooling duct being installed to extend into contact with said cylinders in such a manner as to provide cooling of the engine, said cooling duct having a downstream open end held opposite said muffler such that said muffler is exposed to cooling by streams of cooling air from said outlet port.

* * * * *